US006687467B2

(12) United States Patent
Katoh

(10) Patent No.: US 6,687,467 B2
(45) Date of Patent: Feb. 3, 2004

(54) APPARATUS AND METHOD OF CONTROLLING SUPPLY OF DEVELOPING AGENT TO DEVELOPER

(75) Inventor: Tetsuo Katoh, Kunitachi (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/164,714

(22) Filed: Jun. 10, 2002

(65) Prior Publication Data

US 2003/0228164 A1 Dec. 11, 2003

(51) Int. Cl.[7] ..... G03G 15/08
(52) U.S. Cl. ..... 399/30; 399/27; 399/59
(58) Field of Search ..... 399/27, 29, 30, 399/49, 59

(56) References Cited

U.S. PATENT DOCUMENTS 5,787,320 A * 7/1998 Eun et al. ..... 399/27 X
6,459,861 B1 * 10/2002 Sakurai et al. ..... 399/27
6,501,916 B2 * 12/2002 Suzuki ..... 399/30

FOREIGN PATENT DOCUMENTS

JP 5-088554 4/1993
JP 08-146751 * 6/1996
JP 11-327227 * 11/1999

* cited by examiner

*Primary Examiner*—Fred L. Braun
(74) *Attorney, Agent, or Firm*—Foley & Lardner

(57) ABSTRACT

An apparatus for controlling the supply of a developing agent, installed in a developer, is equipped with a developing-agent amount detector to detect an amount of the developing agent consumed by the developer; a driving-time detector to detect a driving time for actually shaking the developing agent provided in the developer; a developing-agent density calculator to calculate an actual density of the developing agent in the developer based on the consumed amount of the developing agent detected by the developing-agent amount detector and the actual driving time detected by the driving-time detector; a developing-agent amount controller to compare the actual density detected by the developing-agent density calculator and a reference developing-agent density to perform forcible supply of the developing agent when the actual density is lower than the reference density whereas forcible consumption of the developing agent when the actual density is equal to or higher than the reference density; and a consumed-amount adjuster to adjust the consumed amount of the developing agent per unit of time under control by the developing-agent amount controller.

17 Claims, 10 Drawing Sheets

APPARATUS AND METHOD OF CONTROLLING SUPPLY OF DEVELOPING AGENT TO DEVELOPER

BACKGROUND OF THE INVENTION

The present invention relates to an apparatus for controlling the supply of developing agent to a developer. Particularly, this invention relates to an apparatus for controlling the supply of developing agent to a developer used in an image forming apparatus such as a plain paper color copy machine and a printer, for printing data transferred from an image-data supplying device such as a personal computer and a digital camera, on plain papers or OHP sheets.

Developers used in image forming apparatus are usually equipped with an automatic supplying mechanism for toner to be consumed in printing. A popular developing technique is two-component developing using developing agent including toner to be used in printing characters and carriers having electrostatic property. Repeated image-forming operations require the supply of toner to cover a detected consumed amount while the carrier amount is almost constant in alternately-performed charging and charge-removing operations.

The amount of toner to be consumed varies between printing a large number of characters and information with a large white area such as a picture and a graph on a sheet of paper. Several factors such as a low printing rate and a high intermittent-printing rate cause variation in toner-consuming rate versus developer-driving time. Discussed below is a relation between a toner amount to be consumed and a developer-driving time.

Repeated intermittent-printing operations cause variation in toner amount to be consumed per developer-driving time due to unproductive driving. Unproductive driving periods exist before the beginning of and also after the end of image-forming operation, in which a developer motor is running for driving the developer while no toner is being consumed. The more the intermittent printing is performed with a pause for every given number of sheet, such as, fifth and second sheet, against continuous printing over a relatively large number of sheets, the more the toner-shaking amount is increased against developer-driving time. Therefore, toner-consuming rate versus developer-driving time depends on the combination of printing rate and intermittent-printing level.

Toner-supply control for conventional developers is disclosed, for example, in Japanese Unexamined Patent Publication No. 5-88554. In detail, a toner supply amount is estimated based on deviation and rate of change in toner density detected by a toner sensor from a reference level. The estimated toner amount is supplied by a supplier per specific number of pixels counted by a counter. This technique offers the supply of appropriate amount of toner in accordance with a consuming amount of developing agent, thus achieving constant developing-agent density in a developer.

The known toner-supply control technique uses toner density and printing rate as basic factors, thus could cause change in developing-agent charged amount if a developer is driven with no toner consumption in a developing agent in the developer. This phenomenon depends on physical properties of toner in the developing agent. In detail, rotation of a developer motor in a developer running with no toner consumption could cause increase in developing-agent charged amount over an appropriate level due to low printing rate or intermittent printing, thus lowering printed-image density, in use of a developing agent including toner that has a tendency of increasing its charged amount. The decrease in printed-image density will not be constant but vary in accordance with printing rate or intermittent printing. Therefore, this known toner-supply control technique poses a problem of unstable image formation.

SUMMARY OF THE INVENTION

A purpose of the present invention is to provide an apparatus for controlling the supply of developing agent to a developer, achieving stable image formation independent of printing rate and intermittent printing, using data on the amount of toner to be consumed in unit of real time obtained based on printing rate and actual developer-driving time.

A developing-agent supply control apparatus for a developer in a first basic configuration according to the present invention for fulfilling the purpose is an apparatus for controlling the supply of a developing agent, installed in a developer, comprising: a developing-agent amount detector to detect an amount of the developing agent consumed by the developer; a driving-time detector to detect a driving time for actually shaking the developing agent provided in the developer; a developing-agent density calculator to calculate an actual density of the developing agent in the developer based on the consumed amount of the developing agent detected by the developing-agent amount detector and the actual driving time detected by the driving-time detector; a developing-agent amount controller to compare the actual density calculated by the developing-agent density calculator and a reference developing-agent density to perform forcible supply of the developing agent when the actual density is lower than the reference density whereas forcible consumption of the developing agent when the actual density is equal to or higher than the reference density; and a consumed-amount adjuster to adjust the consumed amount of the developing agent per unit of time under control by the developing-agent amount controller.

Moreover, a method of controlling the supply of a developing agent for a developer in a second basic configuration according to the present invention, comprising the steps of: a developing-agent amount detecting step to detect an amount of the developing agent consumed by the developer; a driving-time detecting step to detect a driving time for actually shaking the developing agent provided in the developer; a developing-agent density calculating step to calculate an actual density of the developing agent in the developer based on the consumed amount of the developing agent detected by the developing-agent amount detector and the actual driving time detected by the driving-time detector; a developing-agent amount controlling step to compare the actual density calculated by the developing-agent density calculator and a reference developing-agent density to perform forcible supply of the developing agent when the actual density is lower than the reference density whereas forcible consumption of the developing agent when the actual density is equal to or higher than the reference density; and a consumed-amount adjusting step to adjust the consumed amount of the developing agent per unit of time under control in the developing-agent amount controlling step.

Furthermore, an apparatus for controlling the supply of a developing agent, installed in a developer, in a third basic configuration according to the present invention, comprising: means for detecting an amount of the developing agent consumed by the developer; means for detecting a driving time for actually shaking the developing agent provided in the developer; means for calculating an actual density of the developing agent in the developer based on the consumed amount of the developing agent detected by the developing-agent amount detecting means and the actual driving time detected by the driving-time detecting means; means for comparing the actual density calculated by the developing-agent density calculating means and a reference developing-agent density to perform forcible supply of the developing agent when the actual density is lower than the reference density whereas forcible consumption of the developing agent when the actual density is equal to or higher than the reference density; and means for adjusting the consumed amount of the developing agent per unit of time under control by the developing-agent amount controlling means.

DETAILED DESCRIPTION OF EMBODIMENTS

Embodiments for image forming apparatus according to the present invention will be disclosed with reference to the attached drawings.

Figure 1:
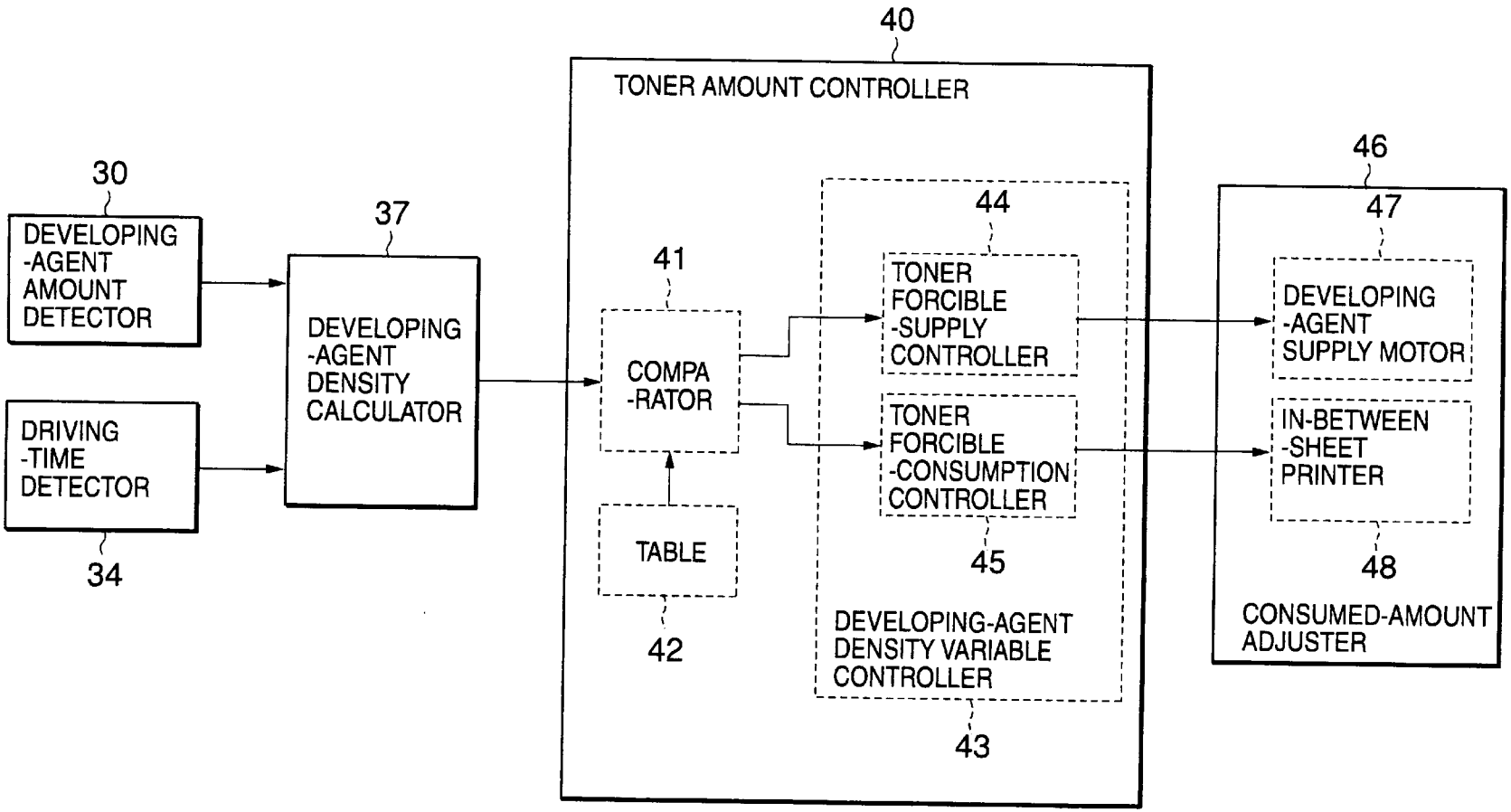
FIG. 1 is block diagram indicating functions of a first embodiment of apparatus for controlling the supply of developing agent to a developer.
Figure 2:
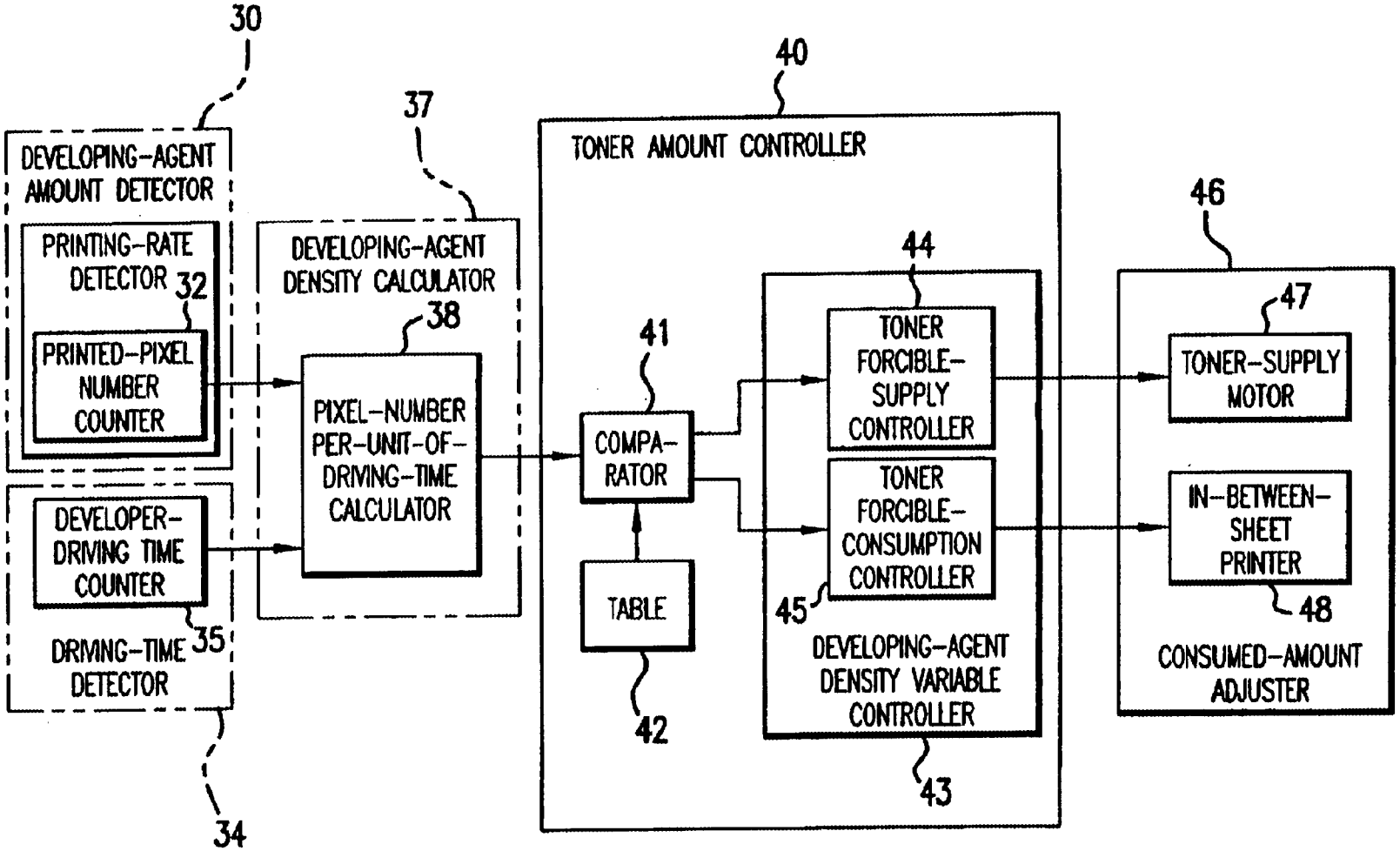
FIG. 2 is block diagram indicating functions of a second embodiment of apparatus for controlling the supply of developing agent to a developer.
Figure 11:
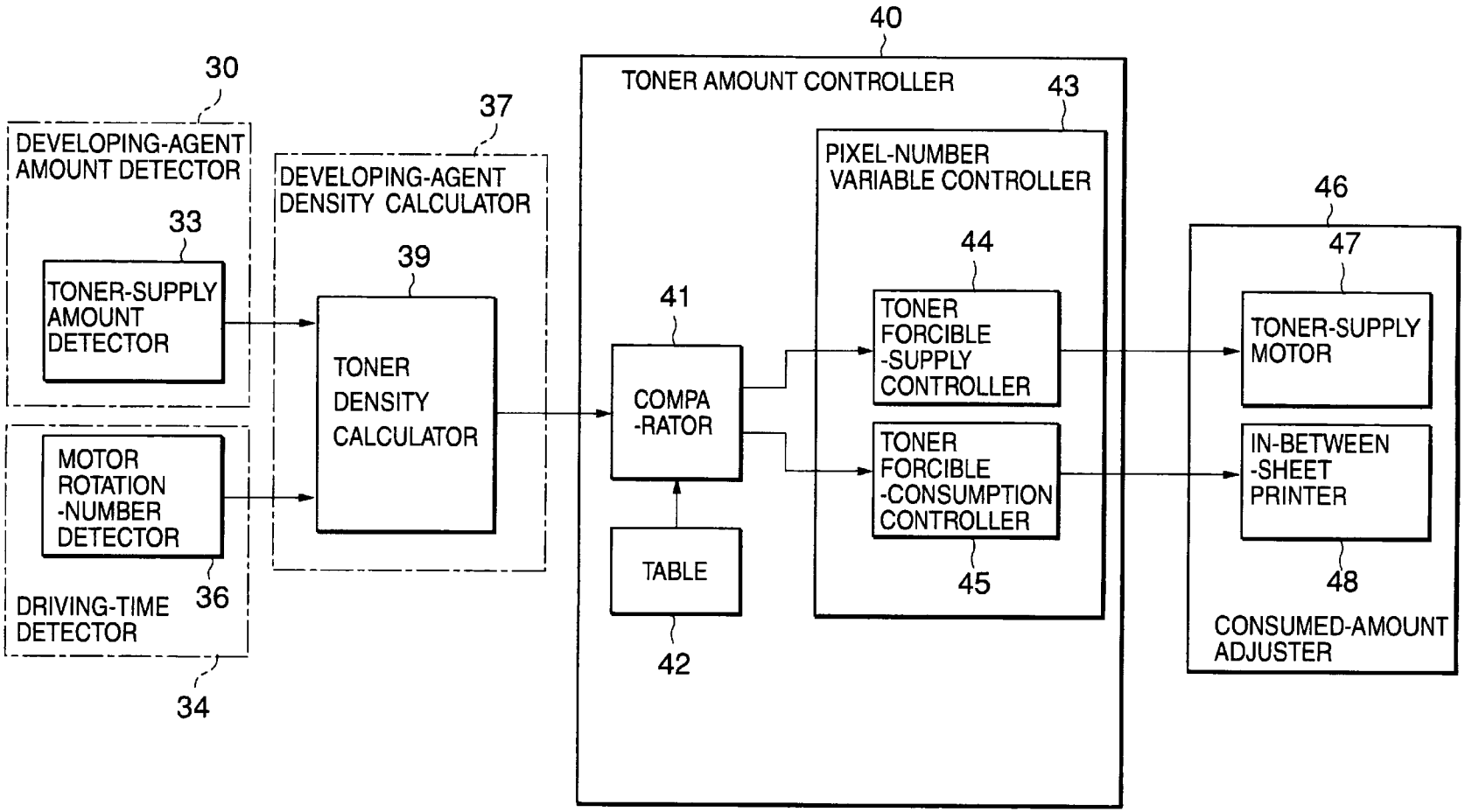
FIG. 11 is block diagram indicating functions of a third embodiment of apparatus for controlling the supply of developing agent to a developer.

FIG. 1 is block diagram of a first embodiment of apparatus for controlling the supply of developing agent to a developer. FIG. 2 is block diagram of a second embodiment of apparatus for controlling the supply of developing agent to a developer. Moreover, FIG. 11 is block diagram of a third embodiment of apparatus for controlling the supply of developing agent to a developer. Disclosed first are schematic structures of a developer and an image forming apparatus in which the developer is installed with reference to FIGS. 3 to 6 before disclosing the first to third embodiments of apparatus for controlling the supply of developing agent to a developer.

Figure 3:
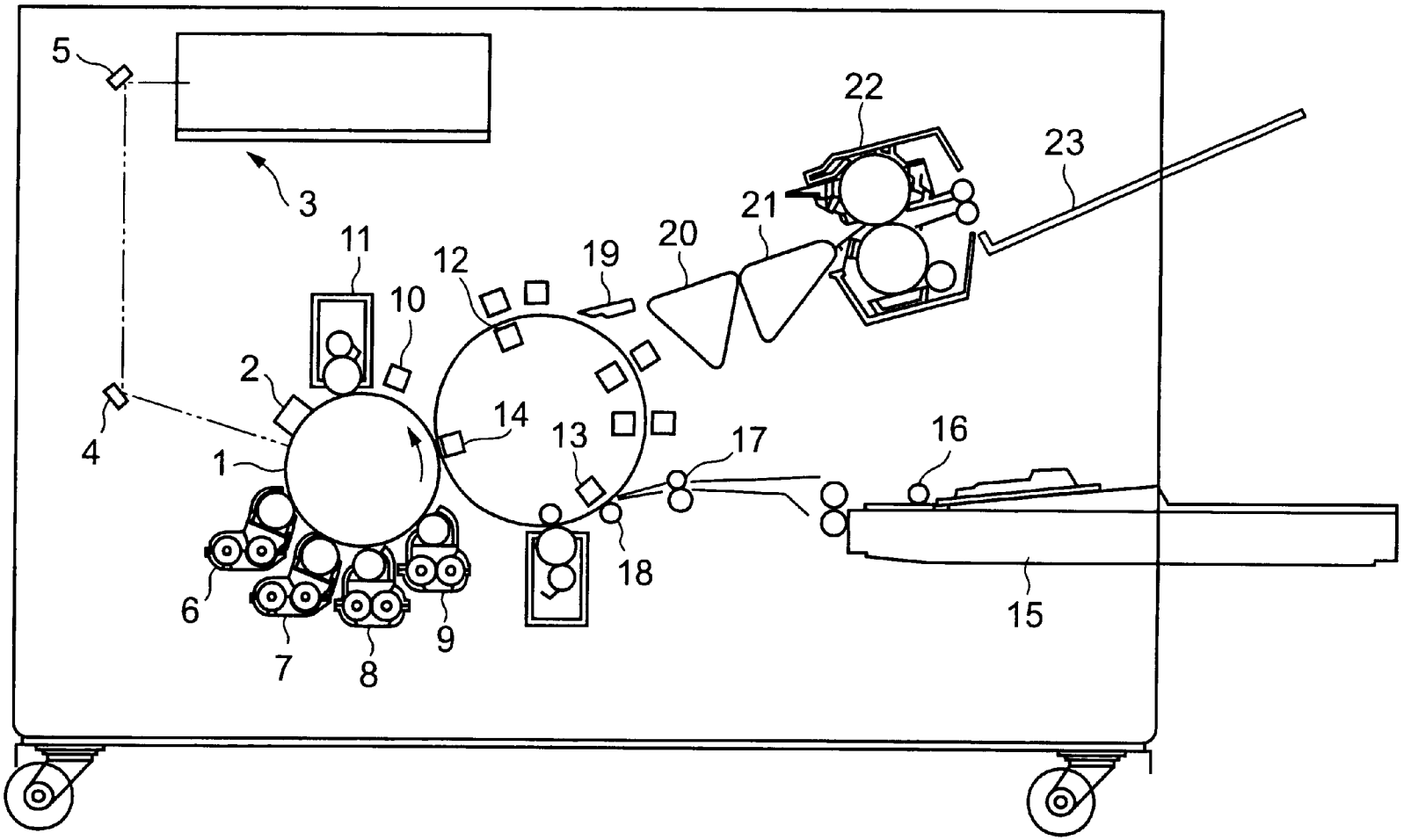
FIG. 3 is a sectional view illustrating a schematic structure of an image forming apparatus in which the apparatus for controlling the supply of developing agent in the first, the second or the third embodiment is installed.

FIG. 3 is a sectional view illustrating a schematic structure of a full-color image forming apparatus in which a developer of the present invention is installed. The image forming apparatus shown in FIG. 3 has a photosensitive drum 1 that rotates in clockwise while carrying images. Provided around the image forming apparatus are a charger 2, a first developer 6, a second developer 7, a third developer 8, a fourth developer 9, a pre-cleaning remover 10, a photosensitive-drum cleaner 11 and a transfer drum 12 for carrying a transfer agent.

Provided between the charger 2 and the first developer 6 are an exposing station 3 and mirrors 5 and 4, as shown in FIG. 3. A recording beam controlled by the exposing station 3 and the mirrors 5 and 4 is guided onto the surface of the photosensitive drum 1 between the charger 2 and the first developer 6, thus an electrostatic latent image being recorded thereon. Although not shown, the exposing station 3 is equipped with a polygon mirror for controlling a laser beam emitted from a semiconductor laser (laser diode), a polygon motor for driving the polygon mirror, a half mirror, a lens, and so on.

The first to the fourth developers 6 to 9 develop electrostatic latent images (to be viewed) formed on the photosensitive drum 1, using toner (developing agent) of four different colors. The first to the fourth developers 6 to 9 use toner of, for example, magenta, cyan, yellow and black, respectively.

The photosensitive drum 1 uniformly charged on its surface by the charger 2 is exposed to the recording beam from the exposing station 3 scanned by image data, thus forming electrostatic latent images thereon. The electrostatic latent images are developed by the developers 6 to 9 corresponding to the image data and then transferred, by a transfer charger 14, on each sheet of paper that is a transfer agent electrostatically sucked on the transfer drum 12. A transfer toner attached on the photosensitive drum 1 is removed by the pre-cleaning charge remover 10 and then cleaned away by the photosensitive-drum cleaner 11.

Each sheet is supplied from a cassette 15 by a paper-feed roller 16 and temporarily held between registration rollers 17. The sheet is supplied from the registration rollers 17 to a sucking roller 18 and a sucking charger 13 and electrostatically sucked on the transfer drum 12 by the sucking charger 13.

As disclosed above, toner attached on the transfer drum 12 is transferred onto the sheet by the transfer charger 14 provided as facing the photosensitive drum 1. Multiple-color printing requires the developing and transferring processes repeated four times at most. The sheet on which toner has been transferred is peeled off from the transfer drum 12 by a peeling pawl 19 and sent on transfer belts 20 and 21 to a tray 23 via a fixing station 22.

Figure 4:
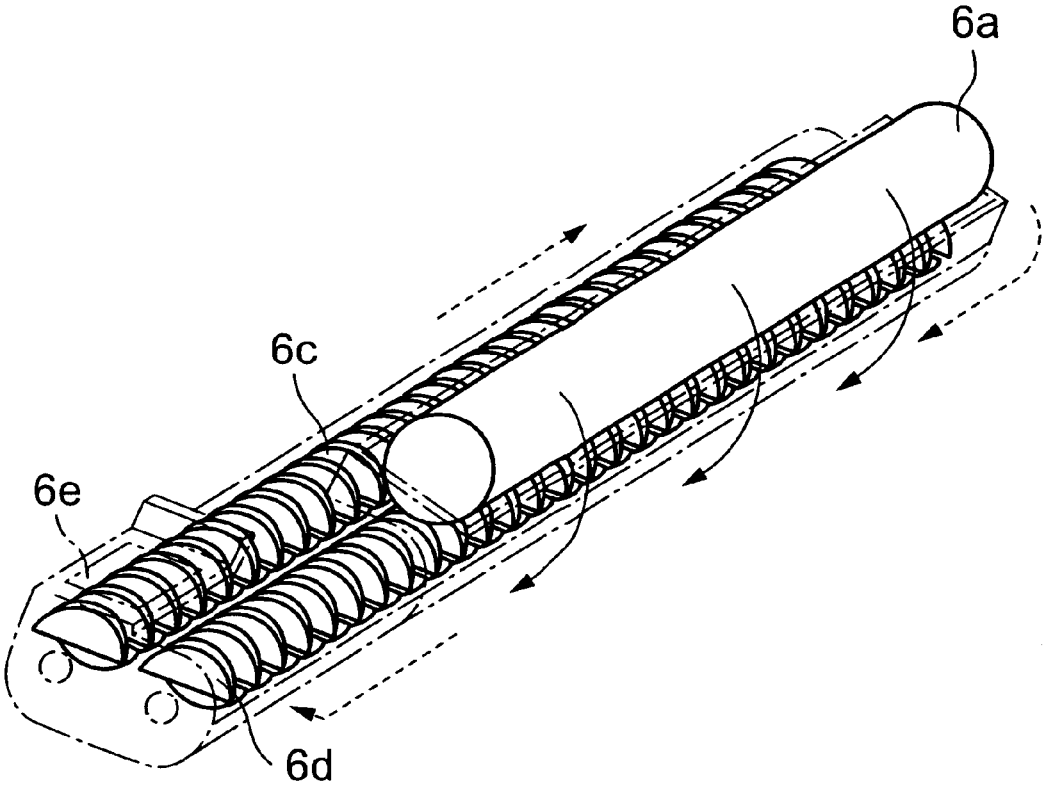
FIG. 4 is a perspective view illustrating a developer for which the apparatus for controlling the supply of developing agent in the first, the second or the third embodiment is employed.
Figure 5:
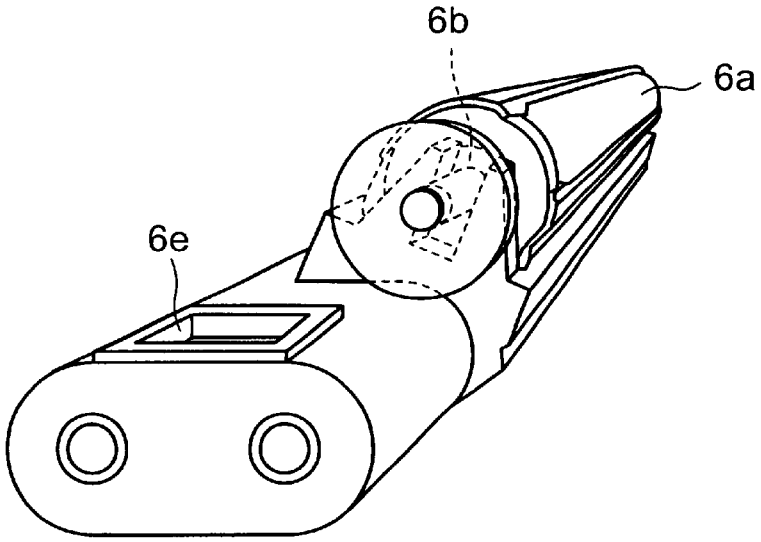
FIG. 5 is another perspective view illustrating the developer for which the apparatus for controlling the supply of developing agent in the first, the second or the third embodiment is employed.
Figure 6:
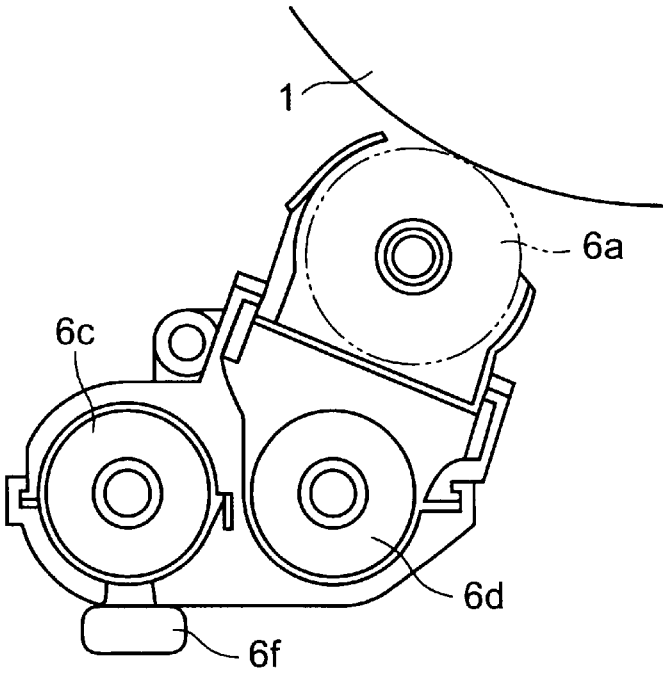
FIG. 6 is still another perspective view illustrating the developer for which the apparatus for controlling the supply of developing agent in the first, the second or the third embodiment is employed.

Disclosed next with reference to FIGS. 4 to 6 are the structure of the first to the fourth developers 6 to 9. Illustrated in FIGS. 4 to 6 is the first developer 6 as a representative of the four developers, the second to the fourth developers 7 to 9 having the same structure. As shown in FIGS. 4 to 6, the developer 6 has a developing sleeve 6*a* having a built-in magnet, a bearing 6*b*, mixers 6*c* and 6*d* for mixing toner and carrier, a toner inlet 6*e* and a toner sensor 6*f* for detecting toner amount (density).

In the developer 6, the developing sleeve 6*a* and the mixers 6*c* and 6*d* are rotated by a driving power from a driver (not shown) running in response to a developing start signal supplied by a controller disclosed later with reference to FIGS. 1, 2 and 11, etc. The developing sleeve 6*a* is positioned close to the photosensitive drum 1 by a push-up mechanism (not shown), with a necessary gap for developing. The developing sleeve 6*a* and the mixers 6*c* and 6*d* cease rotation when the developing process is brought in a halt in response to a developing halt signal from the controller described later. The push-up mechanism releases the developing sleeve 6*a* which then descends to its initial position due to its own weight.

The mechanism disclosed above selectively makes the first to the fourth developers 6 to 9 being apart from the photosensitive drum 1 to prevent color mixture which may otherwise occur on the drum 1 due to mixture of toner of several colors from developers not in use.

Toner and carrier in the developer 6 are sent in a direction depicted by a dot line while being mixed by the mixers 6*c* and 6*d*. A developing agent including the toner and carrier is then circulated in the developer 6 with an almost constant toner density. In addition, toner supplied from a toner hopper (not shown) through the toner inlet 6*e* is circulated in the developer 6.

In between the developing sleeve 6*a* and the mixer 6*d*, the toner and carrier are sent in a direction depicted by an arrow (FIG. 4) and supplied to the developing sleeve 6*a*. The toner sensor 6*f* is positioned almost at the center under the mixer 6*c* to detect carrier magnetic permeability for detecting a toner amount in the developer 6.

The supply of toner is discussed briefly. Image forming apparatus apply necessary procedures to image data to be printed through which gradation steps (0 to 1, 1/256 intervals) per pixel to be printed are decided. The printing processes described above are performed based on the decided data. As printing proceeds, toner in each of the developers 6 to 9 is consumed. The toner amount to be consumed is proportional to or has one-to-one correspondence with pixel counting. The pixel counting produces an integral obtained by accumulating printing gradation steps per pixel to be printed. The supply of toner matching the amount of toner consumed whenever pixel counting reaches a specific level achieves constant toner amount (density) to the developers 6 to 9, and hence achieving printing with stable image density.

Toner requires time a little to be stabilized for its density in each of the developers 6 to 9. In other words, a toner-detected position at the toner inlet 6*e* detected by the toner sensor 6*f* is different from a developed position at the developing sleeve 6*a*, and hence toner density sometimes varies at these positions. The toner-supply control techniques in the first to the third embodiments achieve stability, or elimination of variation in toner amount, which may otherwise occur due to printed pixels being crowded together or scattered or delay in supply timing.

Disclosed next with reference to FIG. 1 is the first embodiment of apparatus for controlling the supply of developing agent to a developer. A developing-agent supply control apparatus shown in FIG. 1 in the first embodiment has a developing-agent amount detector 30 for detecting the amount of a developing agent consumed by a developer; a driving-time detector 34 for detecting a driving time for the developer 6, for example, in which a developing agent is being actually shaken; a developing-agent density calculator 37 for calculating an actual density of the developing agent in the developer 6 based on a consumed amount of the developing agent detected by the developing-agent amount detector 30 and a driving time for the developer 6 detected by the driving-time detector 34; a developing-agent amount controller 40 for comparing the actual density calculated by the developing-agent density calculator 37 and a reference developing-agent density for forcible supply of the developing agent when the actual density is lower than the reference density whereas forcible consumption of the developing agent when the former is equal to or higher than the latter; and a consumed-amount adjuster 46 for adjusting the consumed amount of the developing agent per unit of time under control by the developing-agent amount controller 40.

No types of developing agent are prescribed in use for the developing-agent supply control apparatus shown in FIG. 1 in the first embodiment, which may be a developing agent including toner and carrier or a developing agent having charged toner. Thus, a developing technique used in the first embodiment may not be limited to two-component developing.

The developing-agent supply control apparatus for a developer in the first embodiment has a basic structure in the present invention. Thus, the developing-agent amount detector 30 may count the number of pixels like the second embodiment or detect a toner supply amount like the third embodiment based on a toner amount detected by the toner sensor 6*f*, for detection of developing-agent consumed amount. Moreover, the driving-time detector 34 may measure a developer-driving time or detect the rotation of a toner-shaking motor.

The developing-agent density calculator 37 may calculate the number of pixels per unit of driving time to obtain density of a developing agent or obtain toner density. The developing-agent amount controller 40 may control over the developing agent by forcible supply or consumption under comparison, in a comparator 41, of the reference density, a reference pixel number or toner density, stored in a table 42, with the number of pixels per unit of driving time or the calculated toner density. Such control is achieved by varying density of the developing agent by a developing-agent density variable controller 43 for varying the number of pixels to which toner is to be consumed, etc. The developing-agent density variable controller 43 has a developing-agent forcible-supply controller 44 and a developing-agent forcible-consumption controller 45 for forcible supply and consumption control, respectively.

The consumed-amount adjuster 46 performs developing-agent consumed-amount adjustments as follows: to drive a developing-agent supply motor 47 for supplying the developing agent to a cartridge based on a control signal output from the developing-agent forcible-supply controller 44 in forcible developing-agent supply; whereas drive an in-between-sheet printer 48 for forcibly consuming the developing agent by an amount corresponding to a specific constant number of pixels while sheets as a printing medium are being fed based on a control signal output from the developing-agent forcible-consumption controller 45 in forcible developing-agent consumption.

Figure 7A:
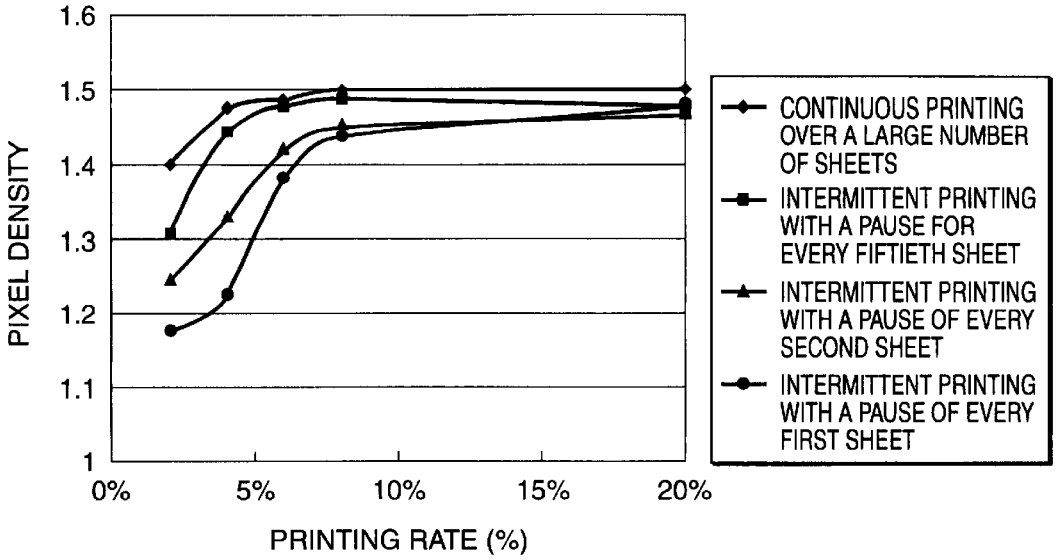
FIGS. 7(*a*) and 7(*b*) are indications of formed-image conditions using two-component developing agent, 7(*a*) and 7(*b*) showing characteristic curves for image density versus printing rate and charged amount versus printing rate, respectively.
Figure 7B:
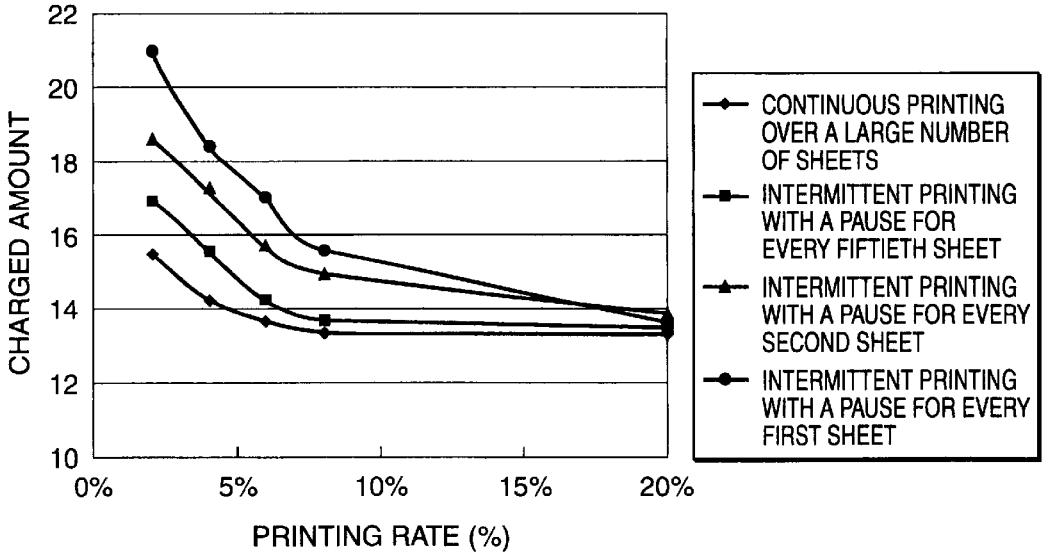

Disclosed next with reference to FIGS. 2 and 7 to is a toner-supply control apparatus in the second embodiment having a more complex structure than the counterpart in the first embodiment having the basic structure.

A developing technique used for the toner-supply control apparatus in the second embodiment shown in FIG. 2 is limited to two-component developing using a developing agent including toner and carrier, to which the first embodiment is not limited though. The second embodiment performs toner consumed-amount adjustments as follows: a printing rate for data to be printed is detected by a pixel counter; a toner consumed amount is calculated per unit of time for driving a developer based on developer-driving time data for a given period; and dummy printing, so called "black-bar printing", is performed over several sheets so that the calculated toner consumed amount will match a reference toner consumed amount per unit of time for driving a developer when the former is less than the latter.

This mechanism offers an image forming apparatus achieving constant image density even if using a material for a developing agent that will be changed to increase charged developing-agent amount when the developers 6 to 9 are continuously driven while toner is not being consumed from the developing agent in the developers, which will be disclosed in detail later with respect to the drawings.

In the two-component developing technique used for the second embodiment, a developing agent including toner and carrier is provided in each of the developers 6 to 9, and new toner only is supplied from a toner supplier to the developer 6 through the toner inlet 6*e* to make up for toner consumed in image formation. The toner supplied in the developer 6 is mixed with a developing agent already provided in the developer 6 by the mixers 6*c* and 6*d* and charged by friction during mixing.

There are two types of material for two-component developing agent. The first type exhibits gradual increase in charged amount (charged rate) of developing agent as driving of the developer 6 is proceeded with no toner consumption. On the contrary, the second type exhibits decrease in charged amount of developing agent against continuous driving of the developer 6 with no toner consumption. The first material type could cause problems such as image formation at low printing rate, low printing speed or more printing time per sheet and low image density during intermittent printing with a pause for every small number of sheet.

For example, as shown in FIG. 7(*a*), image forming apparatus have a tendency to run unproductively at the beginning of and also at the end of image forming operation in intermittent printing with a pause for every fiftieth, second and further first sheet, against continuous printing over a relatively large number of sheets, for image formation at a printing rate of 6% or less. This results in difference in decrease in image density, as shown in FIG. 7(*b*), due to difference in upper limit of charged developing-agent amount over several combinations of requirements.

The toner-supply control apparatus in the second embodiment shown in FIG. 2 enhances image density and charged amount at a printing rate of 6% or less, that are conventionally not in good condition as shown in FIGS. 7(*a*) and 7(*b*). Disclosed below with reference to FIG. 2 is the toner-supply control apparatus in the second embodiment.

In the toner-supply control apparatus in the second embodiment shown in FIG. 2, a developing-agent amount detector 30, the counterpart 30 being shown in FIG. 1, is equipped with a printing-rate detector 31 that has a printed-pixel number counter 32. For example, the number of pixels printed on a sheet is counted for obtaining a printing rate. The printing rate is used for detecting the amount of developing agent, or toner in the second embodiment. A driving-time detector 34 has a developer-driving time counter 35 for measuring a driving time for a two-component developing-agent type developer.

The toner-supply control apparatus in the second embodiment obtains a printing rate based on the number of pixels counted by the printed-pixel number counter, which corresponds to the amount of developing agent, an object to be detected in the first embodiment and also obtains a developer-driving time measured by the developer-driving time counter, which corresponds to the actual mixing-driving time, another object to be detected in the first embodiment. Therefore, a developing-agent density calculator 37 has a pixel-number per-unit-of-driving-time calculator 38 for calculating the number of pixels per unit of driving time. As disclosed, the number of pixels is calculated per unit of driving time based on printing rate in the second embodiment.

Figure 8A:
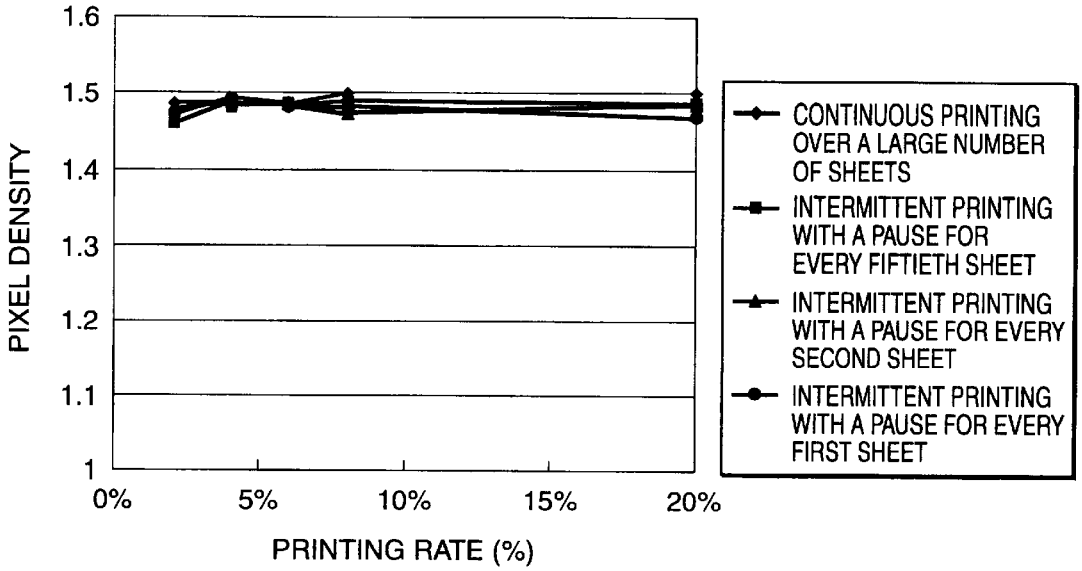
FIGS. 8(*a*) and 8(*b*) are indications of formed-image conditions under enhancement of the characteristic curves shown in FIGS. 7(*a*) and 7(*b*), respectively, 8(*a*) and 8(*b*) showing characteristic curves for image density versus printing rate and charged amount versus printing rate, respectively.
Figure 8B:
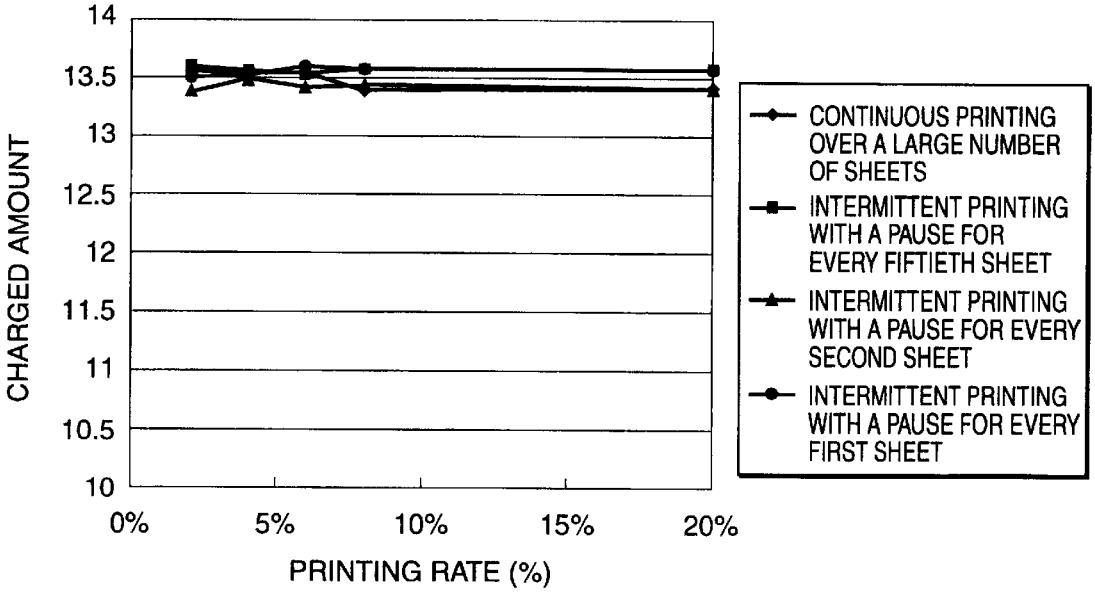
Figure 9A:
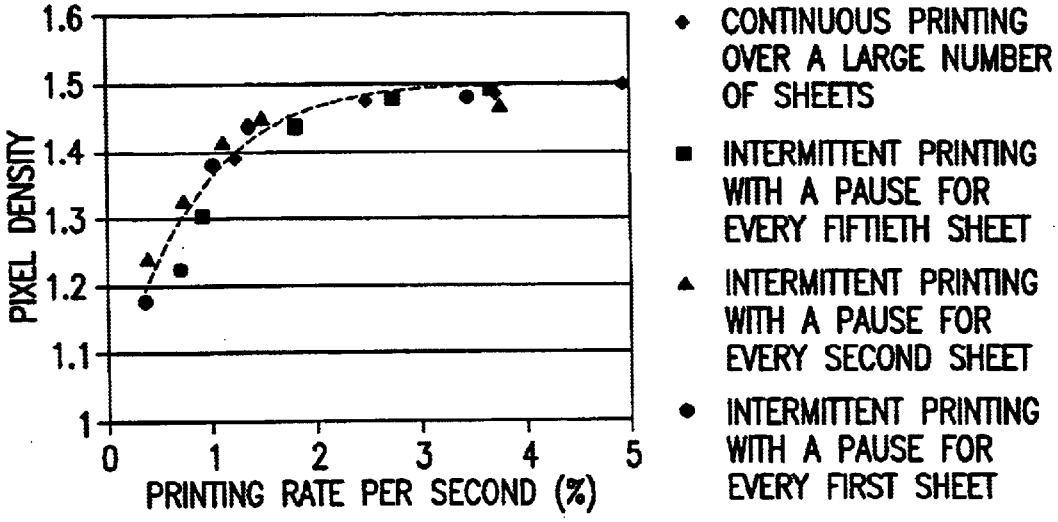
FIGS. 9(*a*) and 9(*b*) are characteristic curves obtained by converting those in FIGS. 8(*a*) and 8(*b*) for printing rate per second, 9(*a*) and 9(*b*) showing characteristic curves for image density versus printing rate per second and charged amount versus printing rate per second, respectively.
Figure 9B:
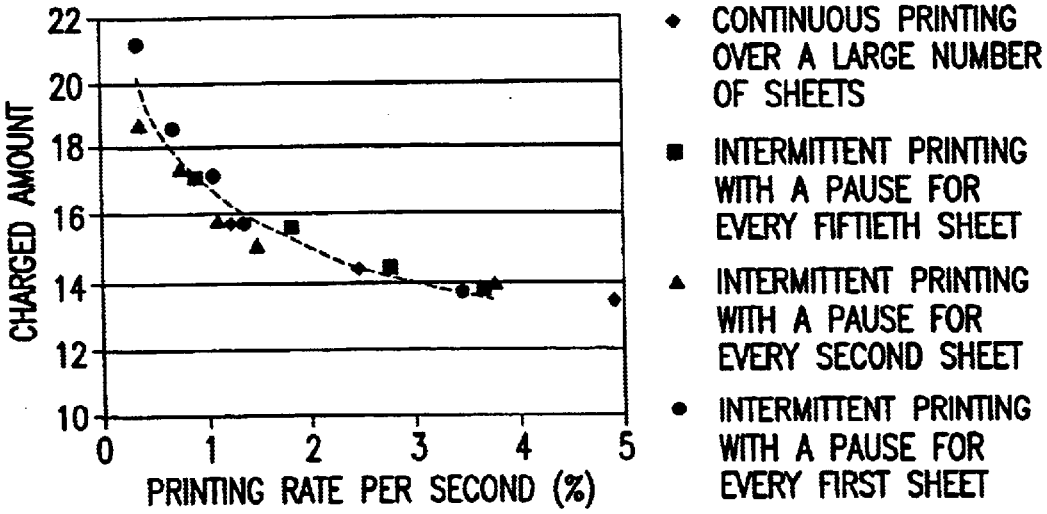

The number of pixels versus printing rate is indicated as characteristic curves in FIGS. 7(*a*) and 7(*b*), FIGS. 8(*a*) and 8(*b*), and also FIGS. 9(*a*) and 9(*b*). FIGS. 7(*a*) and 7(*b*) indicate condition of formed images in general using a two-component developing agent. In detail, the characteristic curves in FIGS. 7(*a*) indicate image density versus printing rate, and those in FIGS. 7(*b*) indicate charged amount versus printing rate. FIGS. 7(*a*) and 7(*b*) teach that image density and charged amount are almost constant at printing rate of 10% or more whereas varied drastically at printing rate less than 10%, particularly 6% or less.

Such characteristics shown in FIGS. 7(*a*) and 7(*b*) are enhanced by the toner-supply control apparatus in the second embodiment, as shown in FIGS. 8(*a*) and 8(*b*). As to condition of formed images, image density varies a little even at printing rate of 6% or less, as shown in FIGS. 8(*a*), the same for charged amount, as shown in FIGS. 8(*b*). The characteristic curves in FIGS. 9(*a*) and 9(*b*) were obtained by converting those in FIGS. 8(*a*) and 8(*b*), respectively, for printing rate per second, respectively. FIG. 9(*a*) indicates image density versus printing rate per second, and FIG. 9(*b*) indicate charged amount versus printing rate per second. FIGS. 9(*a*) and 9(*b*) teach that image density versus printing rate per unit of time and charged amount versus printing rate per unit of time do not vary so much at printing rate of 6% or less.

The difference in characteristic curves between FIGS. 7(*a*) and 7(*b*), and FIGS. 8(*a*) and 8(*b*) teaches that variation in image density and charged amount will occur in the range of low printing rate when toner is shaken continuously without consumed in a developer. This phenomenon can be prevented by toner supply-amount and shaking-level adjustments which are major purposes of the present invention. The toner supply-amount and charged-amount adjustments are achieved by using data on printing rate per unit of time, for stable image formation with no such troubles.

Once printing-rate data per unit of time is gained, as discussed above, a toner amount controller 40 determines whether the toner density and charged amount are enough at this printing rate per unit of time. In detail, a comparator 41 compares the obtained printing rate per unit of time and a reference level stored in a table 42 to generate a control signal to a pixel-number variable controller 43 in accordance with a comparison result as to whether the printing rate is higher (or equal to) or lower than the reference level. For example, the comparator 41 sends a toner high-density signal to a toner forcible-supply controller 44 when determined that the charged amount of the developing agent is large due to low toner density in the developers 6 to 9 but relatively much carriers, whereas sends a toner low-density signal to a toner forcible-consumption controller 45 when the charged amount of the developing agent is small due to high toner density in the developers but relatively few carriers, under comparison of the output of the pixel-number per-unit-of-driving-time calculator 38 with a reference value stored in the table 42.

The pixel-number variable controller 43 sends a toner forcible-supply control signal to a developing-agent supply motor 47 of a consumed-amount adjuster 46 when the toner forcible-supply controller 44 has received the toner high-density signal from the comparator 41. The motor 47 is driven to rotate a toner cartridge (not shown) provided, for example, in the developer 6 among the developers 6 to 9, thus toner being guided and supplied along a guide gutter to the supply inlet 6*e* of the developer 6. On the contrary, the pixel-number variable controller 43 sends a toner forcible-consumption control signal to an in-between-sheet printer 48 of the consumed-amount adjuster 46 when the toner forcible-consumption controller 45 has received the toner low-density signal from the comparator 41. The in-between-sheet printer 48 performs black-bar printing over several sheets under printing to forcibly discharge toner and collect carriers to gain a relatively high developing-agent density.

As disclosed, the toner supply amount and toner consumed amount are adjusted by using printing-rate data per unit of time in the second embodiment for stable image formation even if an actual developer-driving time does not match the developing-agent charged amount and toner consumed amount when toner is continuously shaken without consumed in a developer.

Therefore, the toner-supply control apparatus in the second embodiment achieves precise control over developers with adjustments to an actual developing-agent charged amount by forcible supply or consumption of toner, the amount of which varies due to consumption against almost constant carrier amount.

Figure 10:
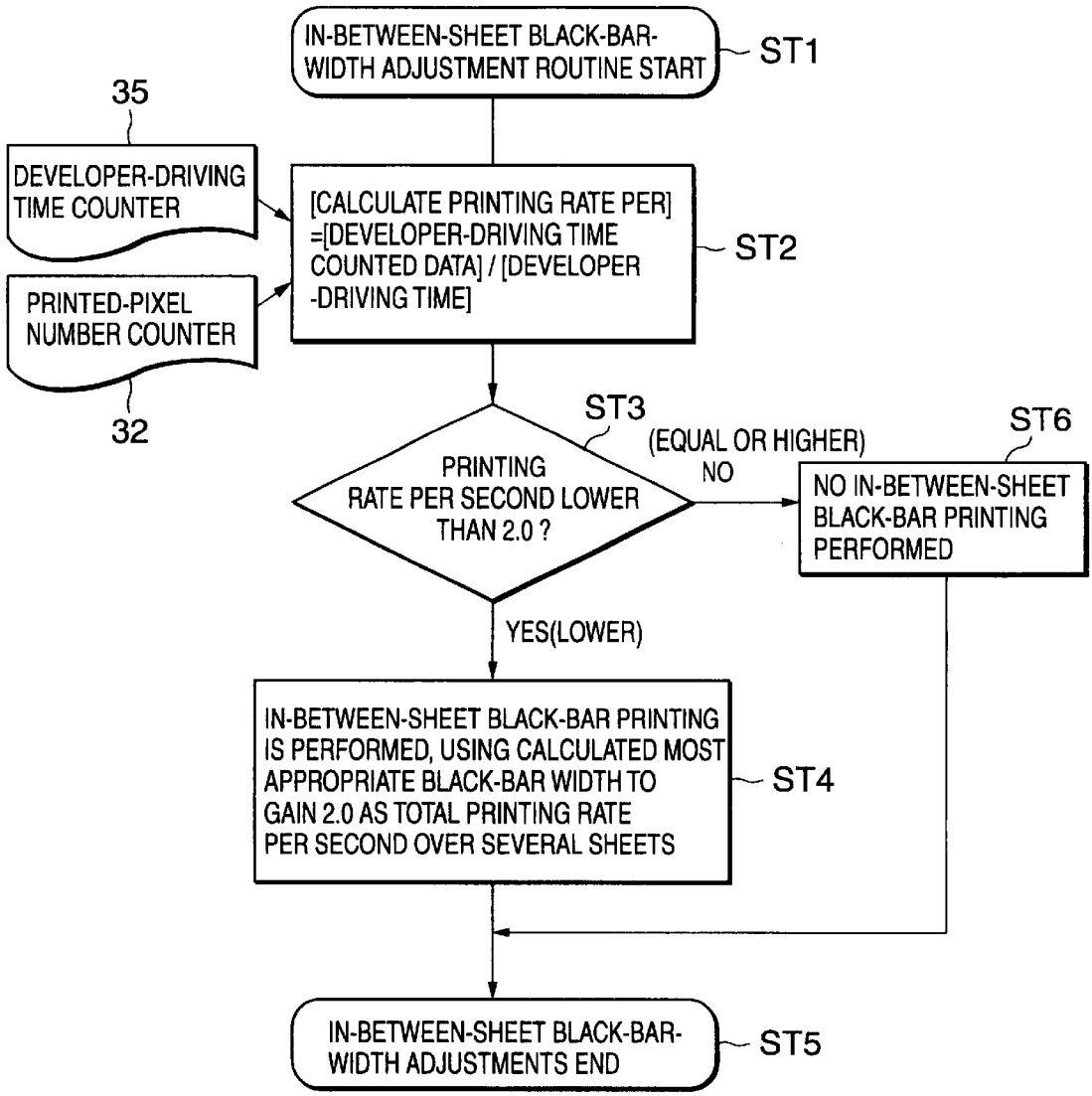
FIG. 10 is a flowchart indicating in-between-sheet black-bar-width adjustment control.

Disclosed next with reference to FIG. 10 is in-between-sheet black-bar-width adjustments as an example of operations of the in-between-sheet printer 48 of the consumed-amount adjuster 46 in the Toner-supply control apparatus in the second embodiment shown in FIG. 2. An in-between-sheet black-bar-width adjustment routine starts in step ST1. Pixel-number data and developer-driving time data counted by the printed-pixel number counter 32 and the developer-driving time counter 35, respectively, of the printing-rate detector 31 are fed to the developing-agent density calculator 37, in step ST2, to divide the number of pixels by the driving time to obtain a printing rate per second.

It is determined in step ST3 whether the printing rate per second obtained in step ST2 is lower than 2.0. The routine goes to step ST4 if determined in step ST3 that the printing rate per second obtained is lower than 2.0. In-between-sheet black-bar printing is performed, in step ST4, using a calculated most appropriate black-bar width to gain 2.0 as the total printing rate per second over several sheets, for forcible toner consumption. The in-between-sheet black-bar-width adjustments end in step ST5.

On the contrary, if determined in step ST3 that the printing rate per second is equal to or higher than 2.0, the routine goes to step ST6 in which no in-between-sheet black-bar printing is performed. No in-between-sheet black-bar printing is required at a printing rate of 2.0 or higher per second because image density will be constant at 2.0 or higher whereas ID-decrease will gradually occur at a printing rate lower than 2.0.

Under the control as disclosed above, the combination of several requirements shown in FIGS. 9(*a*) and 9(*b*) achieves stable toner consumption in developers with constant developing-agent charged amount and almost no decrease in image density, for continuous image formation at a printing rate of 6% or less or intermittent printing with a pause for every fiftieth sheet or first sheet with unproductive-driving periods at the beginning and also the end of image-forming operation, against continuous printing over a elatively large number of sheets.

As disclosed, the toner-supply control apparatus in the second embodiment performs in-between-sheet black-bar printing to gain printing rate of 2.0 or higher per second for a constant developing-agent charged amount if the printing rate is lower than 2.0, thus adjusting the developing-agent charged amount in a stable range for stable image formation. Pre-adjustments to black-bar width to be printed over several sheets for a printing rate of 2.0 or higher achieves relatively stable image formation with no determination of in-between-sheet printing per detection of printing rate like the present invention.

Such pre-adjustments, however, cause unnecessary consumption of toner due to black-bar printing over several sheets always performed beforehand even if a printing rate is 2.0 or higher from the beginning of printing. Contrary to this, the embodiments of the present invention always detect printing rates and determine whether to forcibly supply or consume toner for necessary control, thus achieving efficient image formation with no such unproductive pre-adjustments.

The toner-supply control apparatus in the second embodiment is equipped with the developing-agent amount detector 30 having the printing-rate detector 31 with the printed-pixel number counter 32 and also the driving-time detector 34 having the developer-driving time counter 35. Not limited to this structure, the present invention also provides a toner-supply control apparatus as a third embodiment, as shown in FIG. 11, equipped with a developing-agent amount detector 30 having a toner-supply amount detector 33 and a driving-time detector 34 having a motor rotation-number detector 36.

In addition, the toner-supply control apparatus as a third embodiment shown in FIG. 11 is equipped with a developing-agent density calculator 37 having a toner-density calculator 39. A toner amount controller 40 as a developing-agent amount controller and a consumed-amount adjuster 46 shown in FIG. 11 are equivalent in structure to their counterparts for the toner-supply control apparatus in the second embodiment shown in FIG. 2. The second embodiment employs the printing-rate detector 31 (in detail, the printed-pixel number counter 32) for detection of developing-agent amount discussed with respect to FIG. 1. Instead, the third embodiment directly detects a toner amount in a toner cartridge. Moreover, the second embodiment employs the driving-time detector 34 having the developer-driving time counter 35. The third embodiment, however, employs the motor rotation-number detector 36 for detecting the rotation number of a motor for shaking a developing agent in a developer.

In the toner-supply control apparatus in the third embodiment, a toner density is calculated by the toner-density calculator 39 based on a toner-supply amount, from a toner cartridge, detected by the toner-supply amount detector 33 and also a developer-driving time detected by the motor rotation-number detector 36. The calculated toner density is compared, by a comparator 41, with a reference toner density stored in a table 42. A control signal is then sent to a pixel-number variable controller 43 from the comparator 41 for forcible toner supply or consumption determined under the comparison.

The toner-supply control apparatus in the third embodiment detects a toner supply amount from a toner cartridge for detection of printing rate (toner consumption amount) instead of a pixel counter. In detail, a toner supply amount is detected based on detection of a driving time for a toner-supply motor. This toner-supply amount detection corresponds to printing-rate detection in the second embodiment.

Moreover, the third embodiment detects a developer-driving time based on the number of rotation for a motor that shakes a developing agent in a developer with no driving-time counting. A toner density is then calculated by the calculator 39 based on the detected toner supply amount and motor rotation number. Toner will be supplied only once per printing of one sheet at a printing rate of 20% for a system in which toner supply is performed only when a toner density detected by a toner-density sensor is lowered than a reference level, for example.

In detail, the third embodiment performs a single toner-supply operation (during 1-sec motor rotation) per 10-sheet printing at a printing rate of 2% while the toner-supply motor is rotating for one second for this single toner-supply operation. Therefore, the third embodiment achieves calculation of the printing rate and toner density with comparison of developer-driving time and toner-supply motor rotation time each detected for every 100th printed sheet. In addition, the third embodiment achieves calculation of the number of sheets per number of which a printing operation halts for a short period (intermittent printing), by using a developer-driving time.

The present invention further provides a method of controlling the supply of developing agent as a fourth embodiment, employing the first, the second or the third embodiment of developing-agent supply-amount control apparatus. The method of controlling the supply of developing agent in the fourth embodiment achieves control of the supply of developing agent for a developing-agent supply-amount control apparatus installed in a developer. In detail, the fourth embodiment features a basic configuration including a developing-agent amount detecting step for detecting the amount of a developing agent consumed by a developer; a driving-time detecting step for detecting an actual driving time for shaking the developing agent provided in the developer; a density calculating step for calculating an actual density of the developing agent in the developer based on the developing-agent consumption amount detected in the developing-agent amount detecting step and the actual driving time detected in the driving-time detecting step; a developing-agent amount controlling step for comparing the actual density calculated in the density-calculating step and a reference developing-agent density to perform forcible supply of the developing agent when the actual density is lower than the reference density whereas forcible consumption of the developing agent when the former is equal to or higher than the reference density; and a consumed-amount adjusting step for adjusting the amount of developing agent to be consumed per unit of time under the control in the developing-agent amount controlling step.

The basic configuration for the method of controlling the supply of developing agent in the fourth embodiment may be arranged in a first configuration in that the developing-agent amount detecting step counts the number of image pixels formed on a printing medium, the driving-time detecting step measures a driving time for a motor installed in a developer to drive a shaker for shaking toner as the developing agent provided in a toner cartridge installed in the developer, and the density calculating step calculates the number of pixels per unit of driving time based on the detected driving time and counted number of pixels.

The first configuration for the method of controlling the supply of developing agent may be arranged in a second configuration in that the developing-agent amount controlling step compares the number of pixels per unit of driving time and a reference number of pixels per unit of driving time stored in a table to generate a forcible-supply control signal for forcible supply of toner as the developing agent when the calculated number of pixels is smaller than the reference number of pixels whereas generate a forcible-consumption control signal for forcible consumption of toner when the former is equal to or larger than the latter.

In the second configuration for the method of controlling the supply of developing agent, the consumed-amount adjusting step may adjust driving of a toner-supply motor for forcible supply of toner in response to the forcible-supply control signal and also adjust in-between-sheet printing for forcible consumption of toner in response to the forcible-consumption control signal generated in the developing-agent amount controlling step installed in the pixel-number variable controller.

Moreover, the basic configuration for the method of controlling the supply of developing agent in the fourth embodiment may be arranged in a third configuration in that the developing-agent amount detecting step detects the amount of toner as the developing agent supplied from a toner cartridge in which the toner is being provided, the driving-time detecting step detects the number of rotation of a shaking motor for shaking the toner as the developing agent in a developer, and the developing-agent density calculating step calculates a toner density based on the detected toner supply amount and the number of rotation of the shaking motor.

The third configuration for the method of controlling the supply of developing agent may be arranged in a fourth configuration in that the developing-agent amount controlling step compares the calculated number of pixels per unit of driving time and a reference number of pixels per unit of driving time stored in a table to generate a forcible-supply control signal for forcible supply of toner as the developing agent when the calculated number of pixels is smaller than the reference number of pixels whereas generate a forcible-consumption control signal for forcible consumption of toner when the former is equal to or larger than the latter, for variable toner-number control.

In the fourth configuration for the method of controlling the supply of developing agent, the consumed-amount adjusting step may adjust driving of a toner-supply motor for forcible supply of toner in response to the forcible-supply control signal and also adjust in-between-sheet printing for forcible consumption of toner in response to the forcible-consumption control signal generated in the developing-agent amount controlling step.

What is claimed is:

1. An apparatus for controlling the supply of a developing agent, installed in a developer, comprising:

a developing-agent amount detector to detect an amount of the developing agent consumed by the developer;

a driving-time detector to detect a driving time for actually shaking the developing agent provided in the developer;

a developing-agent density calculator to calculate an actual density of the developing agent in the developer based on the consumed amount of the developing agent detected by the developing-agent amount detector and the actual driving time detected by the driving-time detector;

a developing-agent amount controller to compare the actual density calculated by the developing-agent density calculator and a reference developing-agent density to perform forcible supply of the developing agent when the actual density is lower than the reference density whereas forcible consumption of the developing agent when the actual density is equal to or higher than the reference density; and a consumed-amount adjuster to adjust the consumed amount of the developing agent per unit of time under control by the developing-agent amount controller.

2. The apparatus for controlling the supply of a developing agent according to claim 1, wherein the developing-agent amount detector has a printing-rate detector to detect a printing rate that indicates a ratio of an image formed on a printing medium to the total area of the printing medium.

3. The apparatus for controlling the supply of a developing agent according to claim 2, wherein the printing-rate detector has a printed-pixel number counter to count the number of pixels of the image formed on the printing medium.

4. The apparatus for controlling the supply of a developing agent according to claim 1, wherein the printing-rate detector has a printed-pixel number counter to count the number of pixels of the image formed on the printing medium;

the driving-time detector has a developer-driving time counter, installed in the developer, to measure a driving time for a motor that drives a shaker shaking toner as the developing agent in a toner cartridge installed in the developer; and the developing-agent density calculator has a pixel-number per-unit-of-driving-time calculator for calculating the number of pixels per unit of driving time based on driving time detected by the driving-time detector and a specific number of pixels counted by a pixel counter as the developing-agent amount detector.

5. The apparatus for controlling the supply of a developing agent according to claim 4, wherein the developing-agent amount controller has a toner-amount controller including:

a table to store at least one reference pixel number per unit of driving time;

a comparator to compare the number of pixels calculated by the pixel-number per-unit-of-driving-time calculator as the developing-agent density calculator and the reference pixel number stored in the table; and a pixel-number variable controller having a toner forcible-supply controller to generate a toner forcible-supply control signal for forcible supply of toner as the developing agent when the calculated number of pixels is smaller than the reference pixel number, and a toner forcible-consumption controller to generate a toner forcible-consumption control signal for forcible consumption of the toner when the calculated number of pixels is equal to or larger than the reference pixel number.

6. The apparatus for controlling the supply of a developing agent according to claim 5, wherein the consumed-amount adjuster includes:

a toner-supply motor to be controlled for forcible toner supply in response to the toner forcible-supply control signal generated by the toner forcible-supply controller of the pixel-number variable controller; and an in-between-sheet printer to perform an in-between-sheet printing operation for forcible toner supply in response to the toner forcible-consumption control signal generated by the toner forcible-consumption controller of the pixel-number variable controller.

7. The apparatus for controlling the supply of a developing agent according to claim 1, wherein the developing-agent amount detector has a toner-supply amount detector to detect an amount of toner as the developing agent supplied from a toner cartridge in which the toner is being charged;

the driving-time detector has a motor rotation-number detector to detect the number of rotation of a shaking motor for shaking the toner as the developing agent in the developer; and the developing-agent density calculator has a toner-density calculator to calculate a toner density based on the toner-supply amount detected by the toner-supply amount detector and the rotation number of the shaking motor detected by the motor rotation-number detector.

8. The apparatus for controlling the supply of a developing agent according to claim 7, wherein the developing-agent amount controller has a toner-amount controller including:

a table to store at least one reference pixel number per unit of driving time;

a comparator to compare the number of pixels calculated by the pixel-number per-unit-of-driving-time calculator as the developing-agent density calculator and the reference pixel number stored in the table; and a pixel-number variable controller having a toner forcible-supply controller to generate a toner forcible-supply control signal for forcible supply of toner as the developing agent when the calculated number of pixels is smaller than the reference pixel number, and a toner forcible-consumption controller to generate a toner forcible-consumption control signal for forcible consumption of the toner when the calculated number of pixels is equal to or larger than the reference pixel number.

9. The apparatus for controlling the supply of a developing agent according to claim 8, wherein the consumed-amount adjuster includes:

a toner-supply motor to be controlled for forcible toner supply in response to the toner forcible-supply control signal generated by the toner forcible-supply controller of the pixel-number variable controller; and an in-between-sheet printer to perform an in-between-sheet printing operation for forcible toner supply in response to the toner forcible-consumption control signal generated by the toner forcible-consumption controller of the pixel-number variable controller.

10. A method of controlling the supply of a developing agent for a developing-agent supply control apparatus installed in a developer, comprising the steps of:

a developing-agent amount detecting step to detect an amount of the developing agent consumed by the developer;

a driving-time detecting step to detect a driving time for actually shaking the developing agent provided in the developer;

a density calculating step to calculate an actual density of the developing agent in the developer based on a consumed amount of the developing agent detected in the developing-agent amount detecting step and the actual driving time detected in the driving-time detecting step;

a developing-agent amount controlling step to compare the actual density calculated in the developing-agent density calculating step, and a reference developing-agent density to perform forcible supply of the developing agent when the actual density is lower than the reference density whereas forcible consumption of the developing agent when the actual density is equal to or higher than the reference density; and a consumed-amount adjusting step to adjust the consumed amount of the developing agent per unit of time under control in the developing-agent amount controlling step.

11. The method of controlling the supply of a developing agent according to claim 10, wherein the developing-agent amount detecting step has a step of counting the number of image pixels formed on a printing medium;

the driving-time detecting step has a step of measuring a driving time for a motor installed in a developer to drive a shaker for shaking toner as the developing agent provided in a toner cartridge installed in the developer; and the density-calculating step has a step of calculating the number of pixels per unit of driving time based on the detected driving time and counted number of pixels.

12. The method of controlling the supply of a developing agent according to claim 11, wherein the developing-agent amount controlling step has a step of comparing the number of pixels per unit of driving time and a reference number of pixels per unit of driving time stored in a table to generate a forcible-supply control signal for forcible supply of toner as the developing agent when the calculated number of pixels is smaller than the reference number of pixels whereas generate a forcible-consumption control signal for forcible consumption of toner when the calculated number of pixels is equal to or larger than the reference number of pixels.

13. The method of controlling the supply of a developing agent according to claim 12, wherein the consumed-amount adjusting step has a step of adjusting driving of a toner-supply motor for forcible supply of toner in response to the forcible-supply control signal and adjusting in-between-sheet printing for forcible consumption of toner in response to the forcible-consumption control signal generated in the developing-agent amount controlling step.

14. The method of controlling the supply of a developing agent according to claim 10, wherein the developing-agent amount detecting step has a step of detecting the amount of toner as the developing agent supplied from a toner cartridge in which the toner is being provided;

the driving-time detecting step has a step of detecting the number of rotation of a shaking motor for shaking the toner as the developing agent in the developer; and the developing-agent density calculating step has a step of calculating a toner density based on the detected toner supply amount and the number of rotation of the shaking motor.

15. The method of controlling the supply of a developing agent according to claim 14, wherein the developing-agent amount controlling step has a step of comparing the calculated number of pixels per unit of driving time and a reference number of pixels per unit of driving time stored in a table to generate a forcible-supply control signal for forcible supply of toner as the developing agent when the calculated number of pixels is smaller than the reference number of pixels whereas generate a forcible-consumption control signal for forcible consumption of toner when the former is equal to or larger than the latter, for variable toner-number control.

16. The method of controlling the supply of a developing agent according to claim 15, wherein the consumed-amount adjusting step has a step of adjusting driving of a toner-supply motor for forcible supply of toner in response to the forcible-supply control signal and adjusting in-between-sheet printing for forcible consumption of toner in response to the forcible-consumption control signal generated in the developing-agent amount controlling step.

17. An apparatus for controlling the supply of a developing agent, installed in a developer, comprising:

means for detecting an amount of the developing agent consumed by the developer;

means for detecting a driving time for actually shaking the developing agent provided in the developer;

means for calculating an actual density of the developing agent in the developer based on the consumed amount of the developing agent detected by the developing-agent amount detecting means and the actual driving time detected by the driving-time detecting means;

means for comparing the actual density calculated by the developing-agent density calculating means and a reference developing-agent density to perform forcible supply of the developing agent when the actual density is lower than the reference density whereas forcible consumption of the developing agent when the actual density is equal to or higher than the reference density; and means for adjusting the consumed amount of the developing agent per unit of time under control by the developing-agent amount controlling means.

* * * * *